US006740161B2

(12) United States Patent
Heide

(10) Patent No.: US 6,740,161 B2
(45) Date of Patent: May 25, 2004

(54) APPARATUS FOR APPLYING ADHESIVE TO BLANKS IN PACKING MACHINES FOR SMOKERS' PRODUCTS AND THE LIKE

(75) Inventor: Jirko Heide, Schwarzenbek (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 187 days.

(21) Appl. No.: 09/785,498

(22) Filed: Feb. 20, 2001

(65) Prior Publication Data

US 2001/0018818 A1 Sep. 6, 2001

(30) Foreign Application Priority Data

Feb. 17, 2000 (DE) ..... 100 07 220

(51) Int. Cl.[7] ..... B05C 1/00
(52) U.S. Cl. ..... 118/253; 118/500
(58) Field of Search ..... 100/258 R, 265, 100/268, 295; 118/241, 242, 256, 126, 113, 120, 121, 253, 500; 101/247, 214; 384/549

(56) References Cited

U.S. PATENT DOCUMENTS 2,338,138 A 1/1944 Sillars
3,550,830 A * 12/1970 Lagogue
5,732,533 A 3/1998 Focke et al.

FOREIGN PATENT DOCUMENTS

| | | |
|---|---|---|
| DE | 1 001 581 | 1/1957 |
| DE | 1 001 180 | 6/1967 |
| DE | 1 511 044 | 8/1969 |
| DE | 195 35 649 A1 | 3/1997 |
| DE | 196 39 259 A1 | 3/1998 |
| DE | 196 39 260 A1 | 3/1998 |

* cited by examiner

*Primary Examiner*—Brenda A Lamb
(74) *Attorney, Agent, or Firm*—Venable LLP; Robert Kinberg; Catherine M. Voorhees

(57) ABSTRACT

A machine for confining cigarettes or packets of cigarettes in converted blanks of paper, cardboard or the like employs a paster serving to apply adhesive to selected portions of successive blanks of a series of moving blanks. In order to compensate for wear upon and/or for misalignment of the paster and/or a back support for the blanks during application of adhesive, the back support is adjustable relative to the paster and/or vice versa in several directions. Such adjustability ensures predictable application of adhesive, such as hot melt, to predetermined portions of the blanks. The back support and/or the paster is or can be biased to a predetermined position relative to the path for the moving blanks.

8 Claims, 3 Drawing Sheets

APPARATUS FOR APPLYING ADHESIVE TO BLANKS IN PACKING MACHINES FOR SMOKERS' PRODUCTS AND THE LIKE

CROSS-REFERENCE TO RELATED CASES

The present application claims the priority of commonly owned German patent application Serial No. 100 07 220.8 filed Feb. 17, 2000. The disclosure of the above-referenced German patent application, as well as that of each U.S. and foreign patent and patent application identified in the specification of the present application, is incorporated herein by reference.

BACKGROUND OF THE INVENTION

The present invention relates to improvements in apparatus for applying adhesive substances to blanks which are to be converted into packets, cartons or other types of receptacles, e.g., into packets which contain arrays of rod-shaped smokers' products or into so-called cartons which contain arrays of cigarette packets or the like. The invention also relates to improvements in the configuration, mounting and utilization of certain component parts, such as back supports or others, of adhesive applying apparatus (often called pasters) which can be utilized in connection with the making of various types of receptacles for arrays or other groupings of discrete commodities.

It is customary to advance various types of discrete blanks and/or continuous or elongated sheets, strips or webs of wrapping material past one or more devices which are designed to apply a suitable adhesive paste to selected portions of such discrete or continuous blanks prior to causing the adhesive-coated portion or portions of a blank to adhere to different portion or portions of the same blank or to one or more different blanks. For example, the flaps and/or tucks at the sides and/or at the top or bottom ends of partially completed cigarette packets must be coated with adhesive and thereupon folded to abut against and to adhere to the adjacent walls, panels, flaps or other parts of the same blank(s) or to portions of different blanks.

A modern paster, e.g., an adhesive applicator which is utilized in a high-speed packing machine for arrays of cigarettes or in a cartoning machine for cigarette packs, normally employs one or more nozzles which discharge a hot melt, a cold melt or another suitable paste in the form of a film, a stream or a strip upon a continuous web or upon selected portions of successive blanks of a series of discrete blanks. The nozzles can be designed to come into actual contact with the running blank or blanks, or of the type which merely discharge adhesive but do not actually engage the running blank or blanks. A presently utilized nozzle (distributed by the German Firm VALCO) is fixedly mounted adjacent the path for the advancement of blanks, and a suitable conveyor system is employed to transport the blanks past the orifice or orifices of the fixed nozzle.

The quality, as well as the appearance (and hence the sales appeal) of a cigarette packet or another container for cigarettes or other smokers' products, depend to a large extent upon the stability of such packs, and this also holds true for the quality and appearance of the aforementioned cartons which are often designed to contain arrays of ten packs, e.g., two superimposed layers each of which contains a row of five neighboring packs. Therefore, satisfactory application of requisite quantities of an acceptable adhesive is of great importance; moreover, the adhesive should be prevented from adhering to parts of a packing machine because any interruptions of operation of such machines, even for short or very short intervals of time (e.g., to clean the machine and to thus prevent patches of adhesive from attracting dust and/or blanks or fragments of wrapping material on their way toward, past and beyond the wrapping station) entail huge losses in output of a modern packing or cartoning machine. Such satisfactory application of adhesive can be ensured by setting up a packing machine in such a way that the area of contact between the orifice of the nozzle of an adhesive applicator and successive blanks is imparted an optimum shape, that the cross-sectional area(s) of the adhesive-discharging orifice(s) in the nozzle matches or match an optimum shape and/or that the blanks are compelled to advance along a predetermined path without any or with negligible stray movements.

It has been found that the establishment of optimum contact between the nozzle of an adhesive applicator and the selected portion or portions of each of a short or long series of successive (coherent or discrete) blanks of wrapping material is one of the critical prerequisites for the making of optically, mechanically and/or otherwise acceptable cigarette packs or other types of smokers' products. The establishment of an optimum contact necessitates the placing of selected portions of each of a series of blanks into surface-to-surface contact with one or more predetermined portions of the surface of a paster.

Published German patent application Serial No. 1 511 044 discloses a paster which employs a metallic leaf spring serving to ensure the establishment of predictable contact between a continuous blank or successive blanks and the nozzle of the paster. The leaf spring is tiltable relative to the nozzle to thus urge the running blank or blanks against the nozzle. A drawback of such proposal is that the leaf spring or springs is or are apt to be moved out of requisite position(s), damaged or deformed during frequent cleaning, maintenance and/or alignment work. This often results in contamination of the external surfaces of the nozzles and/or of other parts of the paster with adhesive paste, in the application of adhesive to the external surfaces of the packs and/or cartons, as well as in the application of adhesive to the external surfaces of machine parts located downstream of the adhesive applicator(s). The misapplied adhesive is likely to be part of adhesive which was intended to be applied to packs, cartons and/or other receptacles the parts of which should be held together by adhesive, i.e., the misapplication of adhesive results or is likely to result in the making of weaker adhesive bonds or in the absence of adhesive bonds because the adhesive was misapplied during intended application to blanks and/or during subsequent processing.

U.S. Pat. No. 5,732,533 (granted Mar. 31, 1988 to Focke et al. for "PROCESS AND APPARATUS FOR PRODUCING PACKS WITH AN OUTER WRAPPER CONSISTING OF PAPER OR THE LIKE") discloses the application of glue patterns to blanks of wrapping material, subsequent deactivation of applied glue, and reactivation of deactivated glue upon completed conversion of blanks into containers for cigarettes and the like. A drawback of such proposal is that the patented machine takes up substantial amounts of space as well as that the additional equipment for the application of adhesive at a location remote from the actual wrapping station, for the setting of adhesive prior to transport of adhesive bearing blanks to the wrapping station, and for reactivation of adhesive at the wrapping station contributes significantly to the cost of the packing machine and to its proneness to malfunctioning. The patentees further propose to press the flaps, closure tabs and like parts of the blanks against each other during the last stage of the wrapping operation, i.e., at a location which is remote from the paster or pasters.

OBJECTS OF THE INVENTION

An object of the invention is to provide a novel and improved apparatus for the application of adhesive to a continuous blank or to a series of successive blanks in such a way that the shapes and/or the quantities of applied adhesive match or closely approximate the required or desired optimum shapes and/or quantities.

Another object of the present invention is to provide novel and improved parts or groups of parts for use in an apparatus of the above outlined character.

A further object of the instant invention is to provide the apparatus with novel and improved means for reducing the percentage of wasted adhesive in a machine for the making of packets, packs, cartons and/or other types of receptacles for smokers' products.

An additional important object of this invention is to provide a novel and improved mounting for the nozzle or nozzles in an adhesive applicator of the above outlined character.

Still another object of the invention is to provide an apparatus which is constructed and assembled in such a way that it can automatically compensate for wear upon several of its parts and which can be put to use in existing cigarette packing, cartoning and/or other types of machines for confinement of smokers' products.

A further object of the invention is to provide a novel and improved method of at least partially automatically compensating for wear upon various parts of adhesive applying devices, especially but not exclusively in devices which can be utilized for the application of adhesive to various parts of wrappers for smokers' products.

Another object of the present invention is to provide a novel and improved method of enhancing the quality of packets, packs cartons and/or analogous containers wherein flaps, panels, walls, tucks and like parts are held together by an adhesive, to reduce the cost of making such containers, and to reduce the numbers of rejects in packing machines for cigarettes and the like.

SUMMARY OF THE INVENTION

One feature of the present invention resides in the provision of a device for urging an at least substantially sheet-like or panel-like advancing blank sideways against an adhesive dispensing implement, such as a paster of the type employed in a cigarette or carton packing machine. The improved device comprises a back support having a surface which is arranged to contact one side of an advancing blank while another side of the blank abuts the implement, and at least one bearing which mounts the back support with freedoms of movement in a plurality of directions relative to the implement.

It is often preferred and advisable to mount the back support with freedoms of movement in three different directions relative to the implement, e.g., in the directions of the three cartesian coordinates which are normal to each other.

The at least one bearing can define at least one pivot axis for the back support, and one of the freedoms then includes or can include pivotability of the back support about the at least one pivot axis. Another of these freedoms can include movability of the back support transversely of the aforementioned axis; such movements of the back support take place, or can take place, while the blank advances in a predetermined direction.

The improved device can further comprise means for yieldably biasing the back support to a predetermined position relative to the at least one bearing. Such biasing means can comprise at least one spring, e.g., at least one coil spring which reacts against the at least one bearing and bears upon the back support.

At least a portion of the aforementioned surface of the back support can have a concave shape or a convex shape.

It is also possible to employ a back support which resembles and acts as a cradle in that it is rockable relative to the at least one bearing.

Still further, it is possible to employ a spherical (universal) joint which acts between the back support and the at least one bearing.

Another feature of this invention resides in the provision of an apparatus which serves to apply an adhesive to substantially sheet- or panel-like blanks. The apparatus comprises means for advancing a series of successive blanks along a predetermined path, an adhesive applicator having a surface which contacts one side of each of the series of successive blanks in a predetermined portion of the path, a back support which contacts another side of each of the series of successive blanks in the predetermined portion of the path, and at least one bearing mounting the back support and/or the applicator with freedom of movement in at least one direction relative to the applicator and/or the back support.

The at least one bearing can include means for mounting at least a portion of the applicator with at least one freedom of movement relative to the other of the back support and the applicator. Such portion of the applicator has two or three freedoms of movement relative to the back support, and such apparatus can further comprise means for yieldably biasing the portion of the applicator to a predetermined position relative to the back support. At least one of the aforementioned two or three freedoms of movement can include the ability of the aforementioned portion of the applicator to pivot about a predetermined axis, and the advancing means of such apparatus can include means for moving successive blanks of the series in a predetermined direction; at least one of the two or three freedoms of movement can include linear movability of the aforementioned portion of the applicator at least substantially transversely of the predetermined direction. Another of these freedoms of movement can include the ability of the aforementioned portion of the applicator to pivot about a predetermined axis. Still further, such apparatus can comprise at least one resilient element which reacts against the at least one bearing and bears upon the aforementioned portion of the applicator to yieldably urge the applicator portion to a predetermined position relative to the back support.

The applicator of the improved apparatus can comprise at least one resilient component, and such applicator can form part of a wrapping machine for smokers' products.

The novel features which are considered as characteristic of the invention are set forth in the appended claims. The improved apparatus itself, however, both as to its construction and the modes of assembling, installing and operating the same, together with numerous additional impartant and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
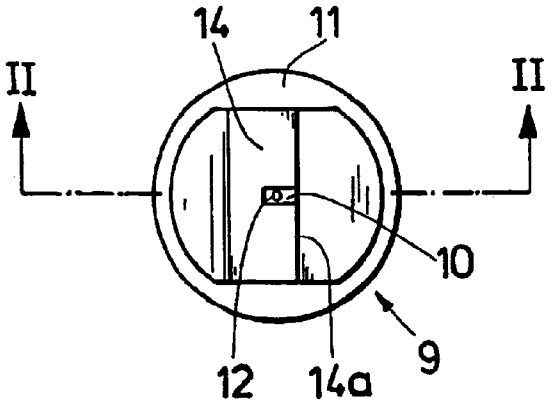
FIG. 1 is a schematic plan view of a portion of a nozzle forming part of an adhesive applicator which is mounted in a packing machine and is constructed and assembled in accordance with a first embodiment of the invention.
Figure 2:
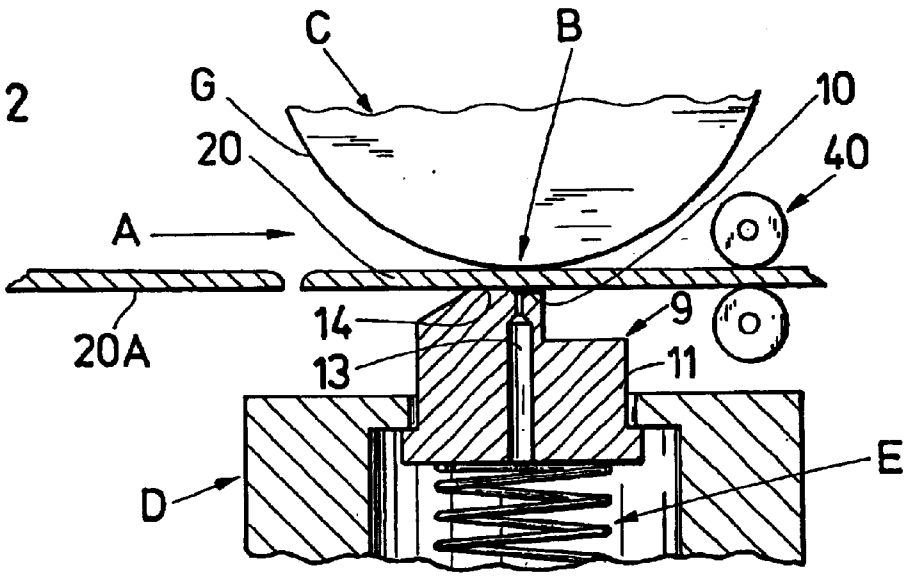
FIG. 2 is a sectional view substantially as seen in the direction of arrows from the line II—II of FIG. 1 and illustrates certain additional important constituents of the adhesive applicator including the structure shown in FIG. 1.

FIGS. 1 and 2 show certain details of an adhesive applicator (hereinafter also called paster) having a nozzle 9 which can be made of a metallic material and includes a body 11 having a surface 14 provided with a groove 10. The latter extends from a shoulder 14*a* to an orifice 12 communicating with a bore 13 serving to supply a flow of adhesive by way of a suitable valve, not shown. The surface 14 contacts one side of each of a series of successive blanks 20, 20A, . . . which are advanced along a predetermined (e.g., horizontal) path in the direction indicated by an arrow A.

The blank advancing means includes pairs of pulleys or rollers (one pair shown at 40) which feed successive blanks 20, 20A, . . . along the nozzle 9 of the paster and thence into the folding or wrapping station(s) of a packing machine wherein the blanks are converted into portions of or into entire receptacles or containers for arrays of commodities, e.g., into packets containing arrays of cigarettes or other rod-shaped smokers' products or into so-called cartons for groups or sets of finished cigarette packs.

A cigarette packing machine which can utilize the improved paster is known as COMPAS 500 packer and is distributed by the assignee of the present application. A carton making and packing machine which, too, can utilize the improved paster is known as B 90 (also distributed by the assignee of the present application). The just mentioned machines can be utilized to make and to process so-called soft packs or so-called hinged-lid packs of plain or filter cigarettes, cigarillos, cigars and the like.

A paster which employs the nozzle 9 shown in FIGS. 1 and 2 can be of the type distributed by the aforementioned German Firm VALCO. In accordance with the presently prevailing practice, the nozzles of the pasters distributed by VALCO are fixedly mounted in packing machines so that the surface 14 of the body 11 of the thus fixed nozzle is contacted by one side of each of a series of successive blanks (such as the blanks 20 and 20A shown in FIG. 2) which are to be provided with patches, strips, films, etc. of a suitable adhesive on their way into the packing machine proper.

By way of example, each of the blanks 20, 20A, etc. can constitute a piece of cardboard which is to be converted into the box-shaped envelope of a carton confining ten cigarette packs each of which contains twenty plain or filter cigarettes. The body 11 of the nozzle 9 shown in FIGS. 1 and 2 can provide the blanks 20, 20A, etc. with one of, for example, three patches or strips or films of adhesive. One of these strips can serve to bond a flap at one end of a future carton, the other strip bonds a flap at the other end of the future carton, and the third strip contains adhesive for the longitudinally extending flap which separably bonds the cover of the carton to a front wall of the latter.

The adhesive which is supplied via bore 13 of the nozzle body 11 shown in FIGS. 1 and 2 can be a hot melt, a cold melt or any other suitable adhesive which can be properly spread by the nozzle 9.

The groove 10 in the surface 14 of the nozzle body 11 extends in the direction (arrow A) of forward movement of successive blanks 20, 20A, etc. The aforementioned valve which regulates the flow of adhesive into and in the bore 13 and thence (via orifice 12) into the groove 10 is regulatable to start and to interrupt the flow of adhesive from a source into the bore 13. If the nozzle is to be utilized as a means for applying to each of the blanks 20, 20A, etc. a finite length of adhesive paste, the aforementioned valve regulates the duration of application of a strip of adhesive to each of a series of successive blanks. Thus, each such blank can receive at least one continuous stream or flow of adhesive extending from the leading to the trailing end of the respective blank, or only one or more adhesive strips of finite length.

Once one side of a blank has been provided with a patch or strip or full coat of adhesive, such blank is caused or permitted to enter the wrapping station for conversion into a receptacle or into a portion of a receptacle which confines a single commodity (e.g., an array of plain or filter cigarettes in the customary quincunx formation) or a set or group of commodities (e.g., two layers of cigarette packs). The converting step can include bonding of the blanks (such as 20 or 20A) to another blank, or bonding of a first portion of a blank to a second portion of one and the same blank. In many or most instances, the application of adhesive by way of the orifice(s) of a nozzle takes place shortly or immediately prior to placing of the thus coated portion of a blank into contact with the uncoated portion of the same blank and/or into contact with the uncoated portion(s) of another blank or other blanks. The just outlined procedure is being resorted to, for example, in connection with the making of the so-called hinged-lid cigarette packs.

FIG. 2 shows that the body 11 of the nozzle 9 is partially confined in a housing or bearing D and that such body is biased by a prestressed resilient element E in the form of a coil spring which reacts against the bearing D and bears upon the body 11 so that the surface 14 of such body bears upon one side of a blank (20) then advancing through the adhesive applying or coating station B under the pull of the advancing means including the rollers or pulleys 40. The surface 14 urges the other side of the blank 20 then at the coating station B to bear upon the cylindrical peripheral surface G of a rotary back support C. The latter is rotatable about a fixed axis in response to the pull exerted upon the bank 20 by the rollers 40 of the blank advancing means. It is also possible to drive the back support C (counterclockwise, as viewed in FIG. 2) at the peripheral speed of the rollers or pulleys 40.

The blanks 20, 20A, etc. can consist (at least in part) of paper, thin cardboard, plastic sheet or board stock or the like. The resilient element E exhibits the advantage that it ensures the establishment of full contact between the surface 14 and the adjacent portion of the underside of the blank (20) at the coating station B, especially since the body 11 of the nozzle 9 has at least some freedom of tilting or rocking movement relative to the bearing D. Such tilting takes place about an axis which is normal to the plane of FIG. 2.

Figure 3A:
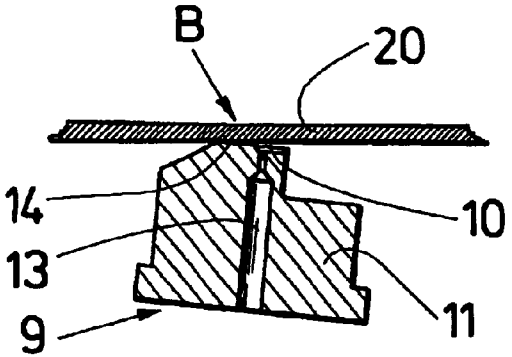
FIG. 3*a* shows the structure of FIG. 3 but with the portion of the nozzle in a different angular position relative to the blank.
Figure 3:
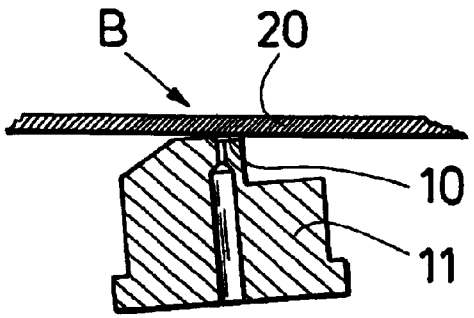
FIG. 3 shows a blank and the nozzle portion of FIG. 2 in a first angular position relative to the adjacent side of the blank.

It can happen (e.g., during cleaning or repositioning of the nozzle 9) that the body 11 assumes an unsatisfactory position or orientation relative to the blank 20 in the path leading from a source (e.g., a stack) of blanks to the blank folding or converting station. FIGS. 3 and 3*a* show two different positions of the body 11 relative to the blank 20 at the coating station B, namely two different positions of the body 11 relative to an axis (see the axis Z in FIG. 5) which is normal to the plane of FIGS. 3 and 3*a*.

In the (exaggerated) angular positions of the nozzle body 11 shown in FIGS. 3 and 3*a*, the surface 14 is in mere linear contact with the adjacent side of the blank 20 at the coating station B. Consequently, the groove 10 in the surface 14 of the nozzle body 11 shown in FIGS. 3 and 3*a* no longer controls the extent of application of adhesive to the adjacent side of the blank 20, i.e., the groove 10 permits the adhesive being supplied via bore 13 to flow toward and away from the observer of FIGS. 3 and 3*a*, to the right (as viewed in FIG. 3) or to the left (as viewed in FIG. 3*a*).

Figure 4A:
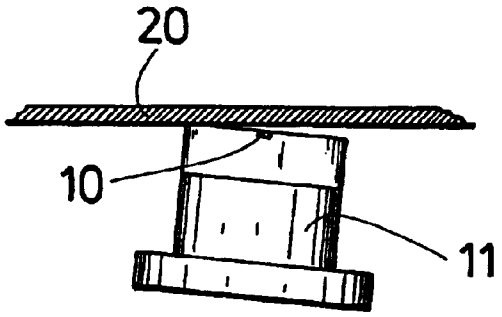
FIG. 4*a* is a view as seen in FIG. 4 but with the portion of the nozzle in a different angular position relative to the blank.
Figure 4:
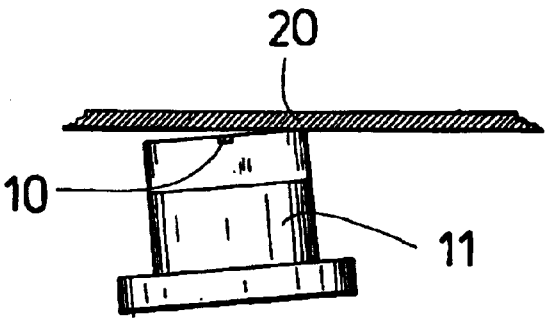
FIG. 4 is a view as seen from the right-hand side of FIG. 3 but with the portion of the nozzle in a different angular position relative to the blank.

In the absence of any undertakings to the contrary, the groove 10 also permits adhesive to flow to the left (as viewed in FIG. 4) and to the right (as viewed in FIG. 4*a*). Otherwise stated, in the absence of means or provisions to ensure that the groove 10 continues to control the rate and the direction of flow of adhesive from the bore 13 to the adjacent side of the blank (20) then advancing past the coating station B, the extent and the location of application of adhesive to that side of the blank at the station B which confronts the nozzle 9 are dependent exclusively upon the orientation of the surface 14 relative to the adjacent side of the blank (20) at the station B. This results in the application of an adhesive layer or film having an outline which departs from the desired or required outline, i.e., the adhesive film is apt to bond parts which should remain unconnected to each other or such film will fail to bond to each other those parts which should or which are expected to be adhesively secured to one another.

In addition, the inability of the surface 14 to limit the flow of adhesive from the bore 13 solely to escape via outlet orifice 12 and groove 10 will result in extensive and rapid contamination of the surface 14 and/or other surface(s) of the nozzle body 11. All such problems are eliminated or rendered much less acute by the simple expedient of ensuring that the surface 14 of the nozzle body 11 is biased against the adjacent side of the blank (20) at the coating station B and/or vice versa. In the embodiment of FIGS. 1 to 4*a*, this is accomplished by the expedient of utilizing the spring E (and/or one or more equivalent or additional resilient means) as a device for urging the other side of the blank at the station B against the cylindrical external surface G of the back support (roller or idler wheel) C. The spring E is or can be adjustable, i.e., its initial bias can be varied within a desired range (e.g., in a manner to be described with reference to the coil spring 32 of the paster shown in FIGS. 5 and 6).

In the embodiment of FIGS. 1 to 4*a*, the nozzle 9 is mounted in such a way that it is free to move (within limits) in at least two different directions from a predetermined (starting) position shown in FIG. 2. The spring E cooperates with the bearing or support D to normally maintain the nozzle 9 in such starting position. In addition, the nozzle 9 is pivotable between the positions shown in FIGS. 3 and 3*a* (i.e., about an axis which is normal to the plane of FIG. 3 or 3*a*) as well as between the positions shown in FIGS. 4 and 4*a* (i.e., about an axis which is located in the plane of FIG. 4 or 4*a*).

Figure 6:
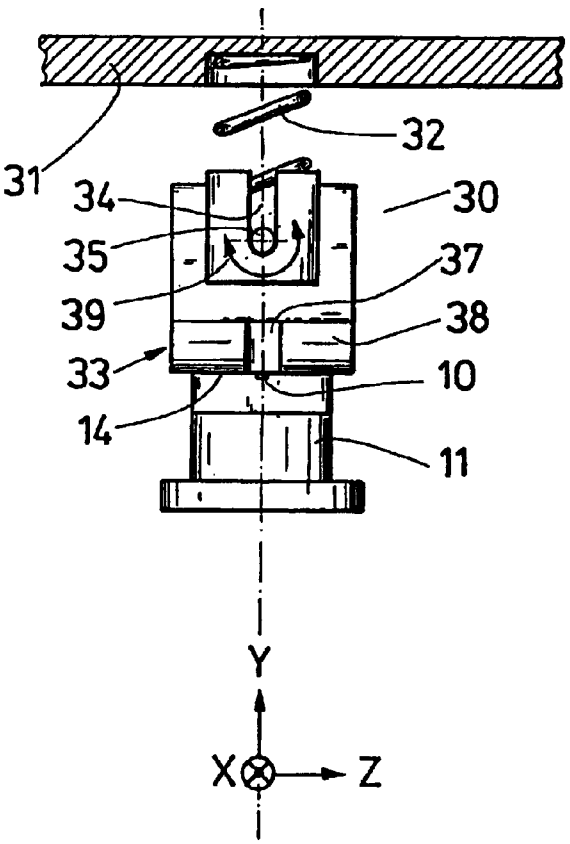
FIG. 6 is a partly elevational and partly sectional view of the modified apparatus substantially as seen in the direction of arrows from the line VI—VI in FIG. 5.
Figure 5:
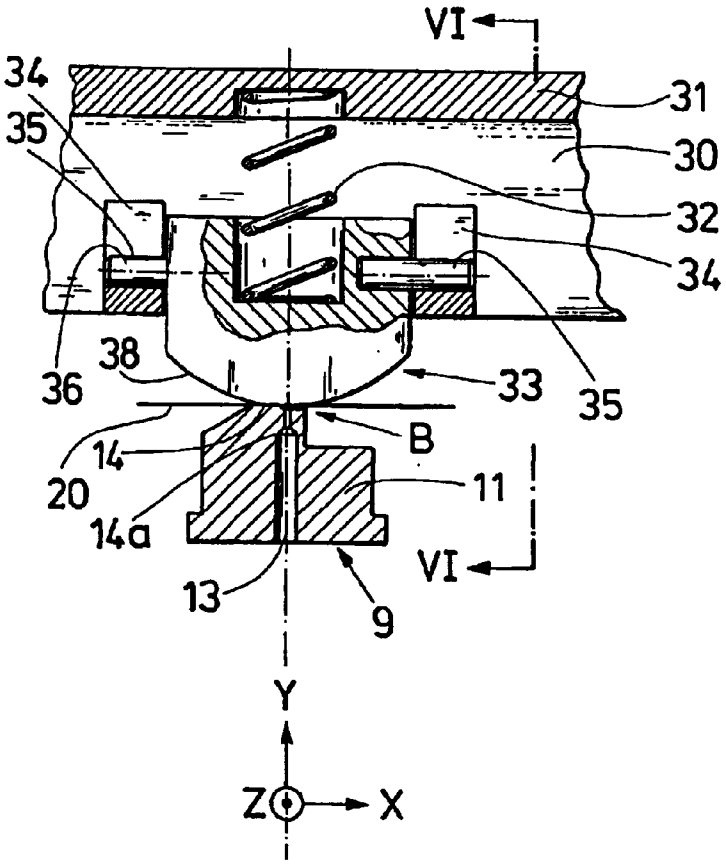
FIG. 5 is a fragmentary sectional view of a modified apparatus which employs a nozzle similar to those shown in FIGS. 1 to 4*a* and shows presently preferred embodiments of a back support for the nozzle and of a bearing for the back support.

The embodiment of FIGS. 5 and 6 differs from the aforedescribed embodiment of FIGS. 1 to 4*a* in that the bearing or support 31 serves as a means for urging (by way of the coil spring 32 or an equivalent resilient element) the back support 33 against one side of the blank 20 at the coating station B so that the other side of such blank simultaneously abuts (in an optimum manner) the surface 14 of the body 11 of the nozzle 9. The latter may but need not be fixedly mounted in the frame of the paster embodying the structure of FIGS. 5 and 6.

The nozzle 9 of FIGS. 5 and 6 can be identical with the similarly referenced nozzle shown in FIGS. 1 to 4*a*; however, the nozzle of FIGS. 5 and 6 is or can be fixedly secured in the frame of the modified paster or directly in the frame of the packing machine which processes the blanks one of which is shown (at 20) in FIG. 5.

The back support 33 acts as and resembles a cradle which is rockable in a plane including the common axis 36 of two pivot pins or shafts 35 received in aligned slots 34 provided in a portion of the bearing 31. The coil spring 32 reacts against the bearing 31 and urges the convex surface 38 of the back support 33 against the adjacent side of the blank 20 advancing at the station B. This causes the underside of the blank 20 to bear upon the surface 14 of the body 11 forming part of the nozzle 9. Thus, in FIGS. 5 and 6, the nozzle 9 can have some freedom of movement in the direction of the Y-axis without causing appreciable departure of the underside of the blank 20 from the surface 14 of the nozzle 9.

Since the underside (38) of the back support 33 is a convex surface, such surface is in a substantially linear contact with the upper side of the blank 20 at the coating station B; such linear contact is established in a direction at right angles to the plane of FIG. 5, i.e., in the plane of FIG. 6.

The nozzle 9 can rock (within limits) back and forth about the axis Z of FIG. 5 without changing the linear contact between the underside of the blank 20 and the surface 14 and/or between the upper side of the blank and the underside 38 of the back support 33. All such (minor) rocking of the nozzle 9 about the axis Z of FIG. 5 amounts to is a slight shifting of linear contact between the sides of the blank 20 on the one hand, and the surfaces 14, 38 on the other hand, to the left or to the right of the position shown in FIG. 5.

The articulate connection 30 which is established (between the back support 33 and the bearing 31) by the pins 35 and slots 34 imparts to the nozzle 9 two additional freedoms of movement relative to the bearing 31. Thus, the spring 32 can yield to permit a movement of the nozzle 9 in the direction of the axis Y, i.e., at right angles to the common axis 36 of the pins 35 (this causes the pins 35 to slide in the respective slots 34 toward and away from the top part of the bearing 31, as viewed in FIG. 5 or 6). The spring 32 is installed in prestressed condition so that it urges the nozzle 9 to the predetermined position of FIGS. 5 and 6 in which the pins 35 are located in the deepmost portions of the respective slots 34.

The axis X is parallel to the common axis 36 of the pins 35 and the nozzle 9 has freedom of back-and-forth rocking movements about the axis 36. Such rocking movements (about the axis 36) of the nozzle 9 are shared by the back support 33.

FIG. 6 shows a groove 37 which is provided in the convex surface 38 in register with the groove 10 in the surface 14 of the body 11 of the nozzle 9. The purpose of the groove 37 is to receive adhesive from the groove 10 when the bore 13 delivers adhesive in the absence of a blank 20 at the coating station B.

In the embodiment of FIGS. 5 and 6, the back support 33, the bearing 31, the spring 32 and the paster or applicator including the nozzle 9 can be caused to cooperate with each other in such a way that, if the blanks 20 are transported to advance in the direction of the X-axis and the back support 33 is movable in and counter to the direction of the Y-axis, the back support has at least two freedoms of movement relative to the bearing 31, namely under and against the bias of the spring 32 (back and forth in the directions of the Y-axis) and angularly clockwise and counterclockwise about the common axis 36 of the pins 35. Movements toward and away from the bearing 31 are possible due to the provision of the slots 34. Movements under and counter to the bias of the spring 32 can be said to be carried out in the plane which is defined by the axes X, Y and movements about the axis 36 are carried out about an axis which is located in such plane.

If the back support 31 has freedoms of movement in three directions, it is or it can be movable universally in any one of the directions in a space, i.e., in a region having a height, a width and a length. Such universal movability can include angular movements about one, two or more different axes, e.g., about the axes X and Z, and linear back-and-forth movements in and counter to the direction indicated by the arrow Y shown in each of FIGS. 5 and 6.

An important advantage of the improved paster is that it can compensate for eventual misalignments of the nozzle, i.e., for movements of the nozzle away from the prescribed or predetermined position, in order to thus ensure that the surface 14 comes into or remains in optimum contact with the adjacent side of the blank (such as 20) which happens to move through the coating station B. The compensation is carried out automatically and can be repeated as often as necessary and to the required extent. Moreover, the improved paster can automatically compensate for manufacturing tolerances as well as for wear upon the component parts. This greatly reduces the frequency of necessary adjustments as well as cleanings, i.e., the total number of down times is reduced and the number of unsatisfactory end products (rejects), such as improperly glued converted blanks, is also well below that of unsatisfactory end products turned out by packing machines employing conventional pasters.

The back support 33 can be replaced with a device having a plane surface or a concave surface in lieu of the convex surface 38. Alternatively, the plane surface can include a concave portion in the region of contact with the adjacent side of a blank 20 at the coating station B. Still further, it is possible to replace the back support 33 with a member which is rockable, not unlike a cradle, and is biased (e.g., by a coil spring) to a predetermined starting position.

Still further, it is within the purview of the present invention to combine the features of the embodiments of FIGS. 1–4*a* and 5–6, e.g., to employ a back support (such as 33) which is movable relative to its bearing (such as 31) and to further employ a nozzle (such as the nozzle 9 of FIGS. 1–4*a*) which is movable with or relative to its back support (D).

It is also possible to employ a universal joint between (a) the nozzle 9 and a back support therefor (such as the part D shown in FIG. 2) and/or (b) between the back support (33) and the bearing (31) therefor. All that counts is to provide a paster wherein the back support (such as 33) has freedoms of movement relative to the bearing (such as 31) in at least two directions and/or wherein the bearing (such as D) mounts the back support (such as C) and/or the applicator or paster (such as the applicator or paster including the nozzle 9 of FIGS. 1–4*a*) with freedom of movement in at least one direction relative to the other of the back support and the paster.

It is also possible to provide the paster of FIGS. 1–4*a* and/or the paster of FIGS. 5–6 with one or more adjustable biasing means. For example, the bearing 31 of FIGS. 5 and 6 can be provided with a plate or plunger which is movable in the direction of the axis Y in order to move the topmost convolution of the spring 32 nearer to the nozzle 9 or to permit such topmost convolution to move further away from the surface 14 of the nozzle.

The spring E or 32 can be omitted if at least a portion of at least one component of the paster consists of a suitable resilient material and if such at least one component is installed in prestressed condition. For example, the spring 32 can be omitted if the upper part of the back support 33 is made of an elastic material and bears upon the underside of the top panel or wall of the bearing 31 shown in FIGS. 5 and 6. Such construction can contribute to simplicity of the improved paster because it allows for a reduction of the number of discrete parts.

The back support 33 can be said to constitute or to act not unlike a cradle having a convex surface 38 which contacts the respective side of the blank 20 advancing through the coating or adhesive applying station B. Te spring 32 tends to return such cradle to or to maintain the cradle or back support in the predetermined position of FIG. 5, i.e., in a position in which the axis of the spring 32 coincides with the axis Y. As already mentioned hereinbefore, the bias of the spring 32 can be adjusted by changing its compression in the direction of the axis Y. The surface 38 can form part of a cylindrical surface having its axis in the plane of the Y-axis. If the just mentioned cylindrical surface is replaced with a spherical surface, it is even simpler to ensure that the back support 33 will have freedoms of movement in more than two directions relative to the nozzle 9.

Except when they are not compatible, the features of the embodiment of FIGS. 5–6 are combinable and/or interchangeable with the features of the embodiment shown in FIGS. 1–4*a*. For example, the bias of the coil spring E can be selected and varied in a manner as already described with reference to the spring 32. Furthermore, at least a portion of the nozzle body 11 and/or of the bearing D of FIG. 2 can be made of a resilient material so that the spring E can be dispensed with or can be utilized in conjunction with such resilient portion of the part 9 and/or D.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art of applying patches of adhesive to blanks of wrapping material and the like and, therefore, such adaptations should and are intended to be comprehended within the meaning and range of equivalence of the appended claims.

What is claimed is:

1. A device for urging an at least substantially sheet-like advancing blank sideways against an adhesive-dispensing implement, comprising:

a back support having a surface arranged to contact one side of an advancing blank while another side of the advancing blank abuts the implement; and at least one bearing mounting said back support, wherein said back support has freedoms of movement in a plurality of directions relative to the implement and said back support includes a cradle which is rockable relative to said at least one bearing.

2. The device of claim 1, wherein said back support has freedoms of movement in three different directions relative to the implement.

3. The device of claim 1, wherein said at least one bearing defines at least one pivot axis for said back support and one of said freedoms includes pivotability of said back support about said at least one pivot axis.

4. The device of claim 3, wherein the advancing blank advances in a predetermined direction, and wherein another of said freedoms includes movability of said back support transversely of said at least one pivot axis.

5. The device of claim 1, further comprising means for yieldably biasing said back support to a predetermined position relative to said at least one bearing.

6. The device of claim 5, wherein said biasing means comprises at least one spring.

7. The device of claim 6, wherein said at least one spring reacts against said at least one bearing and bears upon said back support.

8. The device of claim 1, wherein at least a portion of said surface has one of shapes including a convex and a concave shape.

* * * * *